73-151 SR
8/29/78 OR 4,109,521

United States Patent [19] [11] 4,109,521
Youmans [45] Aug. 29, 1978

[54] METHOD AND APPARATUS FOR LOGGING INCLINED EARTH BOREHOLES USING THE MEASURED ACCELERATION OF THE WELL LOGGING INSTRUMENT

[75] Inventor: Arthur H. Youmans, Houston, Tex.

[73] Assignee: Dresser Industries, Inc., Dallas, Tex.

[21] Appl. No.: 838,682

[22] Filed: Oct. 3, 1977

[51] Int. Cl.[2] ..... E21B 47/00
[52] U.S. Cl. ..... 73/151
[58] Field of Search ..... 73/151, 152; 340/18 R; 166/250; 250/253; 324/10

[56] References Cited

U.S. PATENT DOCUMENTS

| | | | |
|---|---|---|---|
| 4,041,780 | 8/1977 | Angehrn | 73/151 |
| 4,047,430 | 9/1977 | Angehrn | 73/151 |

*Primary Examiner*—Jerry W. Myracle
*Attorney, Agent, or Firm*—Roy L. Van Winkle; John N. Hazelwood

[57] ABSTRACT

An elongated borehole logging instrument includes a permanent magnet linear reciprocating motor. The motor powers a sliding sleeve which has attached to its outer perimeter a series of reversible vanes. The vanes engage the mud cake or the borehole wall and thus generate a force opposite to the direction of the vane slant. The motor has a stationary electromagnetic field comprised of a plurality of coils connected to the control electronics. The floating outer sleeve has permanent magnets all oriented in the same direction. As the coils are pulsed alternatingly, the magnets are either repulsed or attracted to thus generate a reciprocating motion which transferred to the vanes moves the tool up or down, depending upon the position of the reversing actuator. The control electronics is responsive to the difference between the velocity of the well logging instrument, functionally related to its acceleration, and the velocity of the well logging cable at the earth's surface. In an alternative embodiment, a friction reduction agent is ported into the borehole in response to the velocity difference.

7 Claims, 10 Drawing Figures

METHOD AND APPARATUS FOR LOGGING INCLINED EARTH BOREHOLES USING THE MEASURED ACCELERATION OF THE WELL LOGGING INSTRUMENT

BACKGROUND OF THE INVENTION

This invention relates generally to apparatus for logging earth boreholes and specifically to methods and apparatus which utilize means in addition to, or which aid gravity in causing the well logging instruments to traverse the high angled earth boreholes.

It has become relatively common within the last few years to drill wells in the search for oil and gas and the like with a portion of the bore deviating from the usual vertical orientation thereof. The deviation or inclination may extend for a considerable distance at angles ranging to 70°, sometimes returning to the usual vertical orientation. In some instances, such boreholes may even extend past 90° from the vertical and actually be extending in the up direction for some distance.

It is also well known in the art of drilling such wells to attempt the logging of the formations surrounding such boreholes with logging instruments run into the well bore on a wireline and/or a cable to perform various operations. Such tools usually depend upon the force of gravity to permit positioning of the well tool at the desired formation in the well bore.

Manifestly, the relatively horizontal angle of the deviated portion of the well bore will not permit the wireline actuated tools to move into the lower portion of the well bore since friction of the well tool in the deviated portion works against the force of gravity. Thus it has become essential to provide some means of causing the well logging instrument to pass through the deviated portions of the well bore.

Another problem associated with such boreholes relates to the instability of some formations penetrated by the well bore, thus causing borehole diameter changes, some very abrupt. Ledges are formed, and the logging instrument lodges against them.

It is therefore the primary object of the present invention to provide new and improved methods and apparatus for logging earth boreholes;

It is also an object of the present invention to provide methods and apparatus for logging deviated boreholes in which it is difficult for the well logging instrument to traverse the borehole.

The objects of the invention are accomplished, generally, by methods and apparatus which monitor the velocity of the logging cable at the earth's surface, which monitor the velocity of the well logging apparatus itself, and which activate additional means responsive to a comparison of the two velocities which facilitate the movement of the well logging instrument through the borehole.

These and other objects, features and advantages of the present invention will be apparent from the following detailed description taken with reference to the figures of the accompanying drawing, wherein:

FIG. 1 is a schematic view illustrating the drilling of a deviated earth borehole from an offshore platform;

FIG. 2 schematically illustrates a prior art well logging system encountering some of the problems associated with logging a highly deviated earth borehole;

FIG. 3 schematically illustrates a prior art well logging system which has been used in an attempt to overcome some of the problems as graphically illustrated in FIG. 2;

Figure 1:
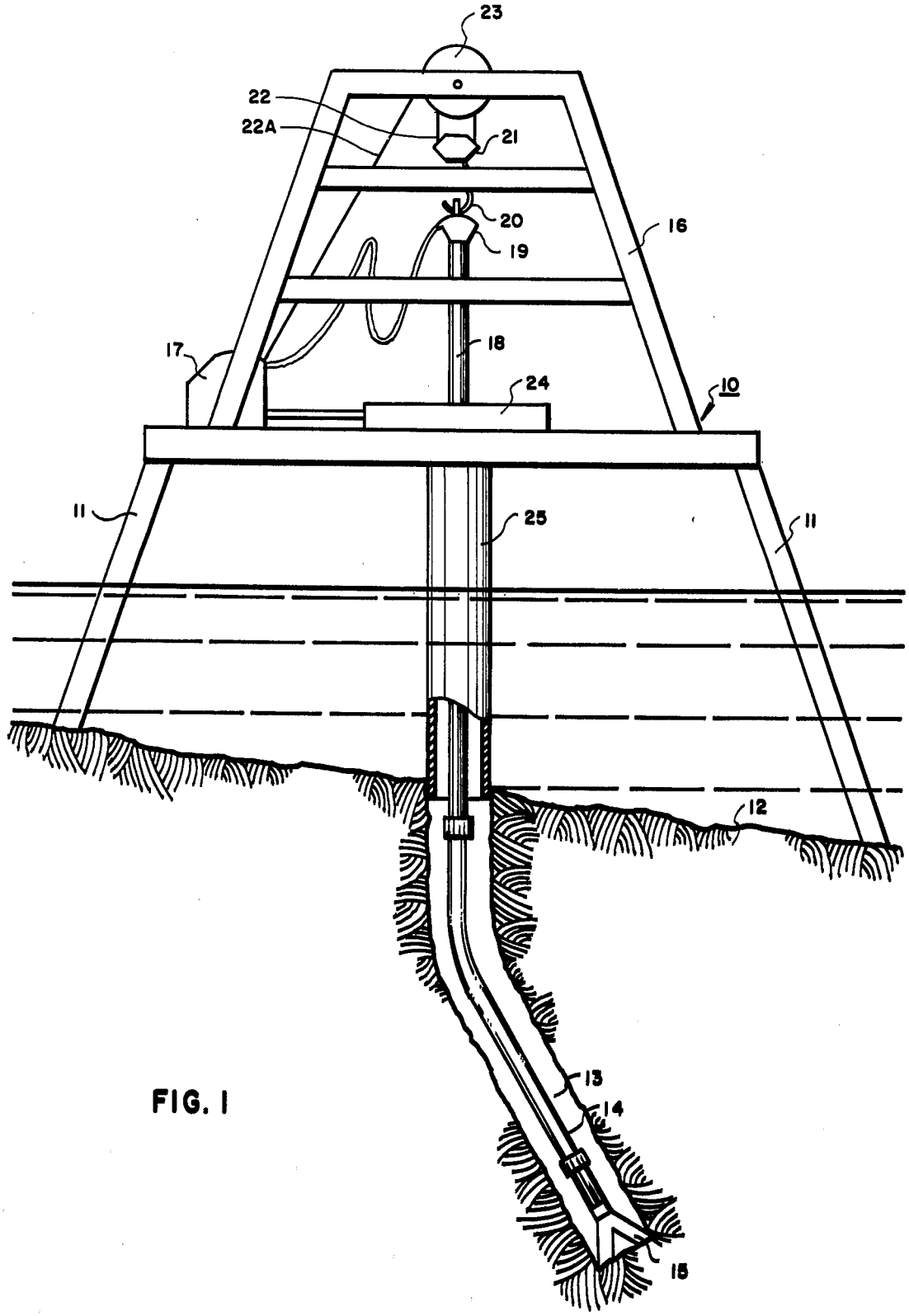

Referring now to the drawing in more detail, especially to FIG. 1, there is illustrated schematically a conventional system for drilling an earth borehole having a high degree of deviation from true vertical. As is well known in the art, it is common practice to drill such slanted wells from offshore platforms. A drilling platform 10 having a plurality of legs 11 anchored on the ocean floor 12 has an earth borehole 13 drilled therefrom. Within the borehole 13 is a pipe string 14, to the lower end of which is attached a drill bit 15. A surface casing 25 maintains the integrity of the borehole 13 as is well known in the art. A derrick 16 with its conventional drawworks 17 is mounted on the platform 10. The drill string 14 comprises a number of joined sections of pipe terminating at its upper end in a kelly 18, followed by a swivel 19, a hook 20 and a traveling block 21 suspended by a drilling line 22 from a crown block 23. The drawworks also drive a rotary table 24 which in turn transmits the drive to the kelly 18. One end of the line 22, namely the fast line **22*a*, is connected to the drawworks 17** which contains the motor or motors for manipulating the drill string. Although not illustrated, the other end of the drill line is secured to an anchor on the platform floor, that portion of the line extending to the anchor from the crown block being generally referred to as the dead line. Again not illustrated, such an anchor member normally would include a winding-on drum and can also, if desired, contain a dead line sensor for monitoring the weight on the bit, for example, as shown in U.S. Pat. No. 3,461,978 to F. Whittle, issued Aug. 19, 1969.

In the operation of the system according to FIG. 1, it is quite conventional in drilling wells from such offshore platforms to drill the initial portion of the well substantially along a vertical line from the platform and then to angle off in the further drilling of the well. Such wells after angline off will oftentimes be inclined at an angle of 60° to 70° from vertical. It is with these types of highly deviated wells that the problem presents itself as to providing a log of the formations surrounding the well bore.

Figure 2:
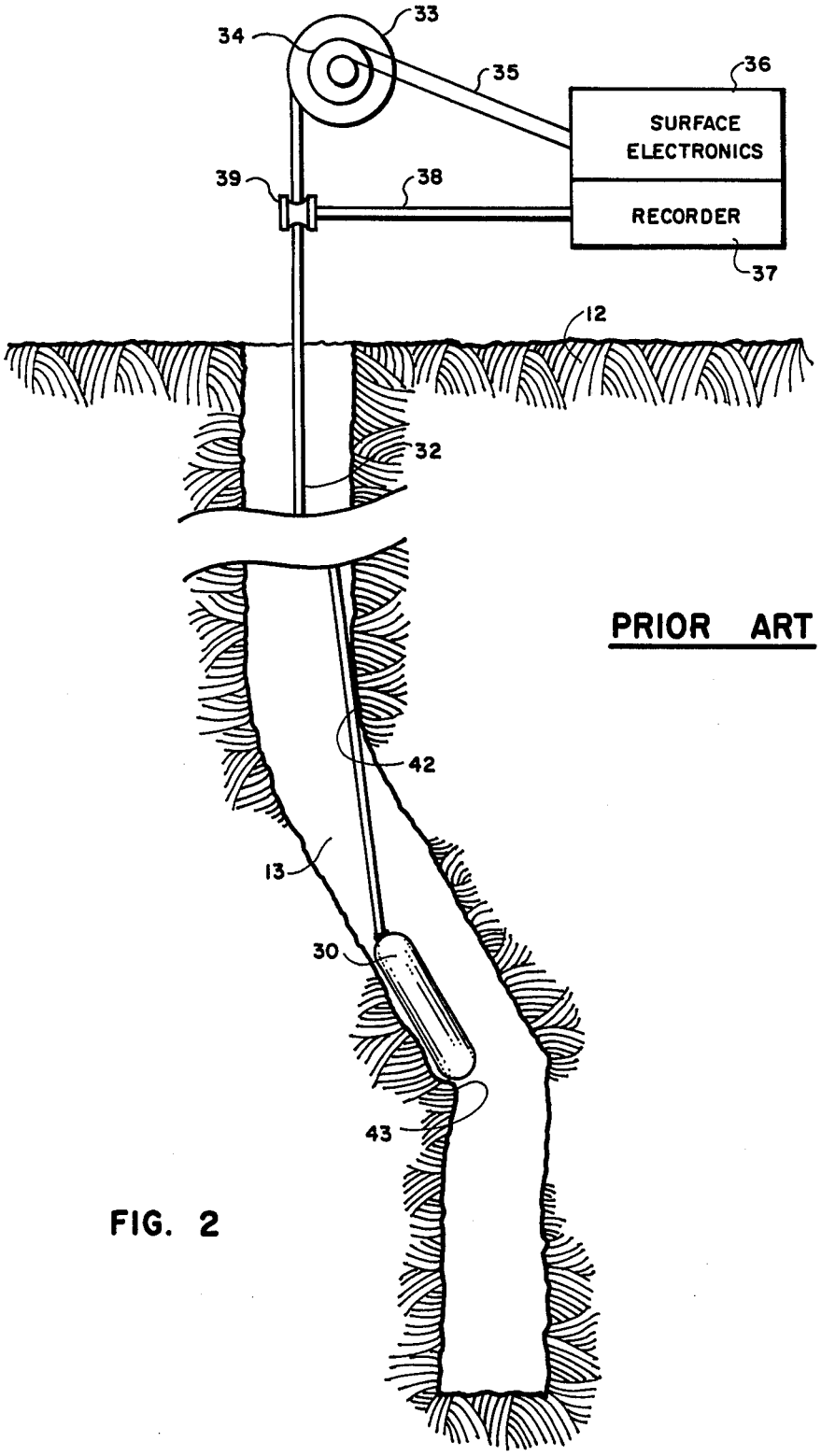
PRIOR ART FIG. 2

Referring now to FIG. 2, there is illustrated schematically a well logging operation conducted in accordance with the prior art in which a portion of the earth's surface 12 is shown in vertical section. A well 13, which has been drilled as illustrated in FIG. 1, penetrates the earth's surface. Disposed within the well is subsurface instrument 30 of the well logging system. The subsurface instrument 30 may be of any conventional type, for example, one which is adapted to conduct an induction, electric, acoustic, or any other of the conventional logs well known in the art. It should be appreciated, moreover, that the particular type of well logging instrument 30 forms no part of the present invention.

Cable 32 suspends the instrument 30 in the well and contains the required conductors for electrically connecting the instrument 30 with the surface electronics. The cable is wound on or unwound from drum 33 in raising and lowering the instrument 30 to traverse the well. During the traversal, the signals from the well logging instrument 30 are sent up the cable 32. Through slip rings and brushes 34 on the end of the drum 33, the signals are conducted by the lines 35 to the surface electronics 36. A recorder 37 connected to the surface electronics 36 is driven through the transmission 38 by the measuring reel 39 over which the cable 32 is drawn, so that the recorder 37 associated with the surface electronics 36 moves in correlation with depth as instrument 30 traverses the well. It is also to be understood that instruments such as the instrument 30 are generally constructed to withstand the pressures and mechanical and thermal abuses encountered in logging a deep well.

In the operation of the system illustrated in FIG. 2, the cable 32 is touching one ledge of the formation at the point 42 and the instrument 30 has come to rest against another such ledge at the point 43, the ledge 43 making it exceedingly difficult, if not impossible, for the instrument 30 to traverse the earth borehole merely by its own weight due to the force of gravity.

Figure 3:
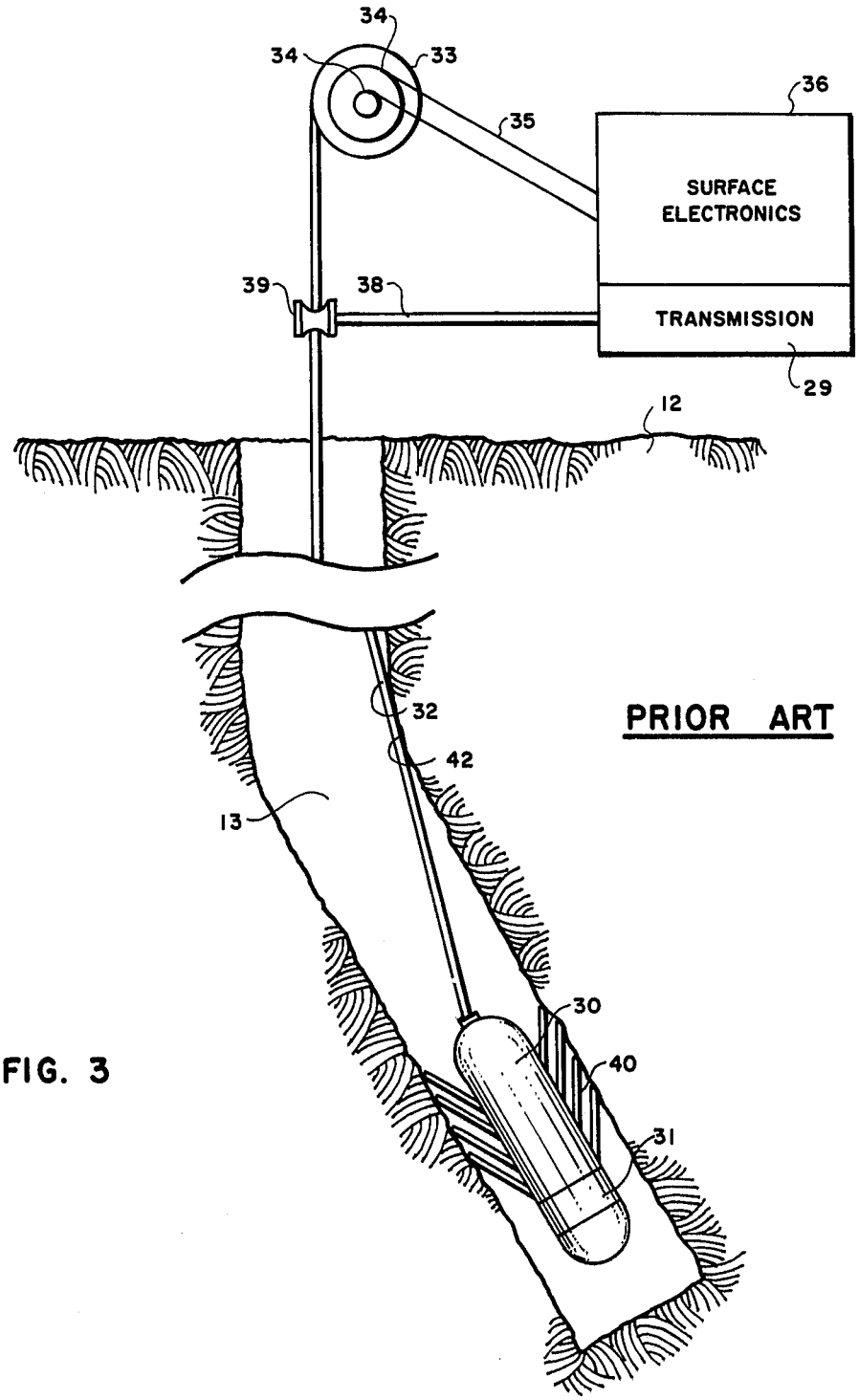
PRIOR ART FIG. 3

Referring now to FIG. 3, there is illustrated schematically a well logging operation which has been used by those in the prior art in an attempt to traverse highly deviated earth boreholes in which a portion of the earth's surface 12 is shown in vertical section. A well 13 which has been drilled as illustrated in FIG. 1 penetrates the earth's surface. Disposed within the well is subsurface instrument 30 of the well logging system. Subsurface instrument 30 includes a logging module 31 which may be of any conventional type. For example, it may be an induction, electric, acoustic or any other of the conventional logs well known in the art. Cable 32 suspends the instrument 30 in the well and contains the required conductors for electrically connecting the instrument 30 with the surface apparatus. The cable is wound on or unwound from drum 33 in raising and lowering the instrument 30 to traverse the well. During the traversal, the signals from the well logging module 31 are sent up the cable 32. Through slip rings and brushes 34 on the end of the drum 33, the signals are conducted by the lines 35 to the surface electronics 36. A recorder (not illustrated) within the surface electronics 36 is driven through the transmission 38 by the measuring reel 39, over which the cable 32 is drawn, so that the recorder within the surface electronics moves in correlation with depth as instrument 30 traverses the well.

As illustrated in FIG. 3, the instrument 30 has a plurality of flexible vanes 40 which are slanted in the upward direction and which, as will be explained in more detail hereinafter, help the instrument 30 to be lowered into the highly deviated borehole.

It should be noted that the cable 32 is resting against a ledge 42 which also hinders the tool 30 from being lowered into the earth borehole simply by the force of gravity.

Figure 4:
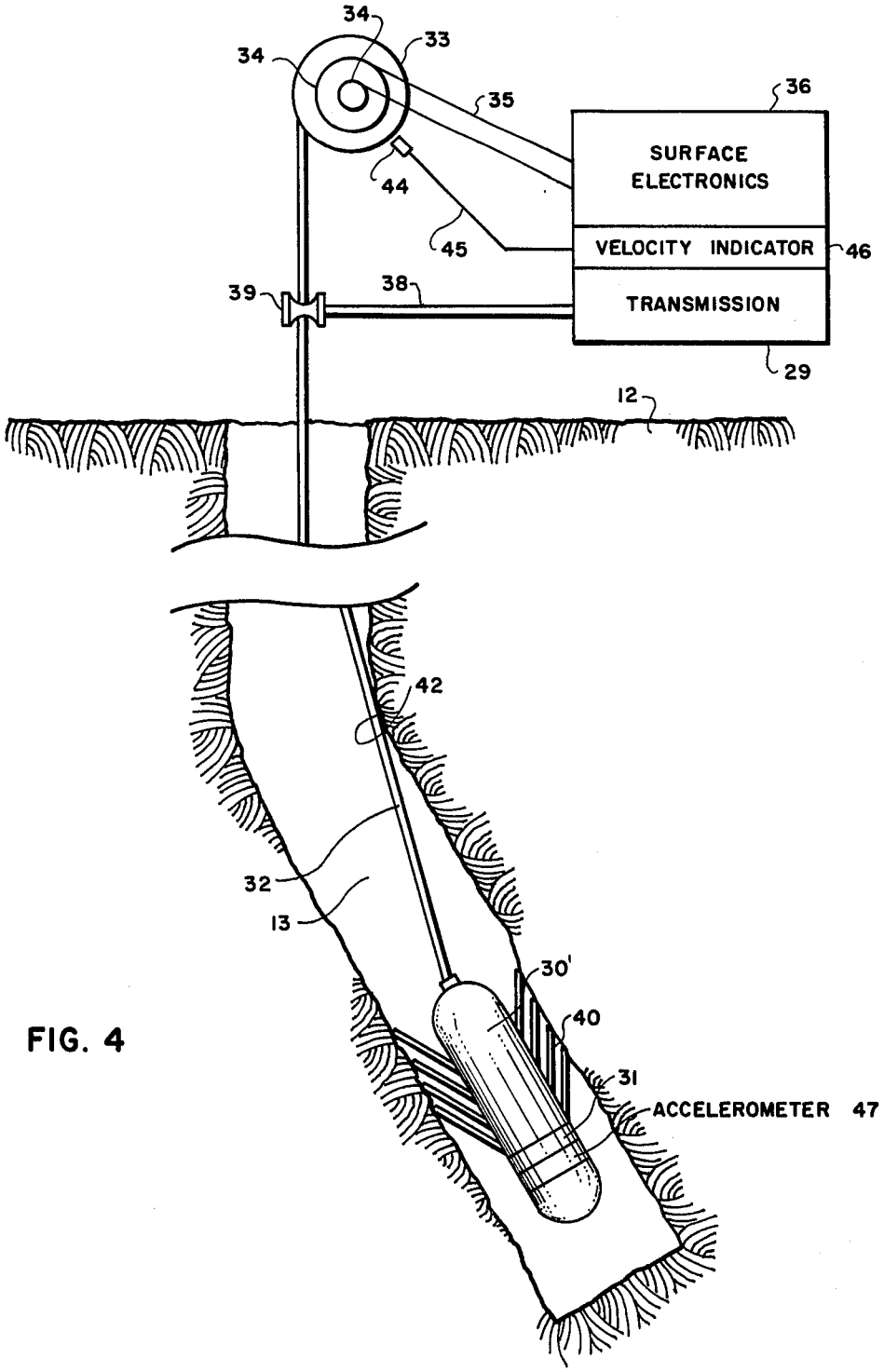
FIG. 4 is an elevated view, partly in cross section, of the apparatus according to the present invention for logging an earth borehole.

Referring now to FIG. 4, there is schematically illustrated a well logging operation in accordance with the present invention which utilizes a well logging instrument 30' constructed substantially as the instrument 30 in accordance with FIG. 3 but which also has an accelerometer 47 for measuring the acceleration of the well logging instrument 30'. In addition, the surface electronics section 36 has incorporated therein a velocity indicator circuit 46 which measures the velocity of either the drum 33 or the cable 32 by means of a sensor 44 which is connected to the velocity indicator circuit 46 by means of the conductor 45, all of which will be discussed in more detail hereinafter.

Figure 5:
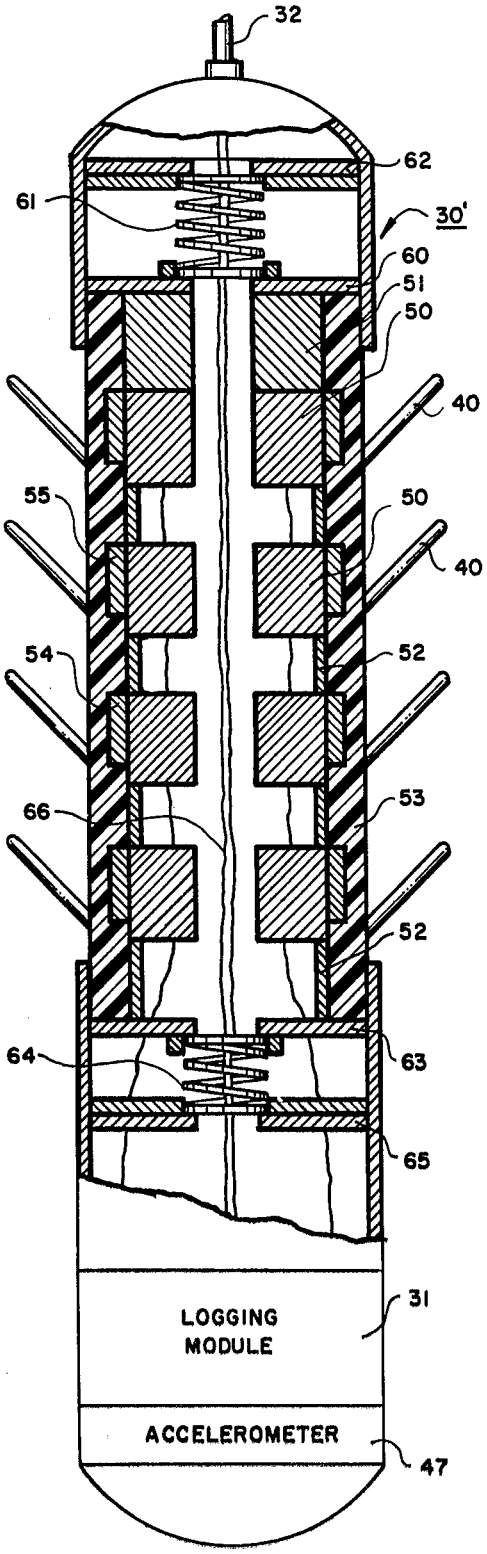
FIG. 5 is an enlarged schematic view, partly in cross section, illustrating the well logging instrument in accordance with the present invention.

Referring now to FIG. 5, the instrument 30' is illustrated in greater detail. The instrument 30' has a plurality of pulsed electromagnets 50 which are fixedly attached to the support mandrel of the instrument housing 30' by the spacer element 51, and by a similar such element 52 between each of the electromagnets. A floating sleeve 53 constructed, for example, from a hard plastic material or some other such material which will not substantially affect the magnetic characteristics of the electromagnets and the permanent ring magnets 54 which are embedded therein, is adapted to slide up and down around the mandrel containing the electromagnets.

The spacer 51 is attached to an end plate 60 which in turn is attached to a spring 61 acting against an additional end plate 62.

In a similar manner, the spacer 52 at the lower end of the mandrel is attached to an end plate 63 against which a spring 64 rides which is attached to an additional end plate 65. Passing through the center of the various end plates and the electromagnets is an electrical cable 66 which is connected to the cable 32 and also to the logging module 31. Electrical conductors are also connected between the various electromagnets and the control electronics incorporated within the logging module 31 for pulsing the electromagnets. This, of course, can be done from the earth's surface or in response to some predetermined occurrence to cause the electromagnets to be pulsed. In the preferred embodiment of the invention, however, the predetermined occurrence is the adverse comparison of the instrument velocity with the velocity of the well logging cable at the earth's surface. The measurement of the instrument velocity is accomplished by the use of an accelerometer 47 within the instrument 30'.

In the operation of the apparatus according to FIG. 5, it should be appreciated that the assembly comprises, effectively, a linear reciprocating motor. The motor powers a sleeve 53 to which the vanes 40 are attached and having a particular slant, in this case slanted in a direction uphole. The permanent ring magnets are all oriented in the same direction. As the coils are pulsed alternatively, the magnets are either repulsed or attracted which thus generates a reciprocating motion which, transferred to the vanes 40, moves the tool up or down, depending upon the position of the reversing actuator discussed hereinafter with respect to FIGS. 6 and 7.

It should be appreciated that the sleeve 53 is effectively floating around the electromagnets because of the springs 61 and 64 at opposite ends of the assembly. However, the invention also contemplates the use of neither of the springs 61 and 64 and having a truly floating sleeve. The invention also contemplates the use of a single spring against which the motor will operate in alternating cycles.

In any event, in the operation of the apparatus in accordance with FIG. 5, in response to an adverse comparison of the two velocities, the vanes 40 will engage the mud cake or the borehole wall and thus generate a force opposite to the direction of the vane slant. This in turn will enable the apparatus in accordance with FIG. 5 to move along the highly deviated boreholes.

Figure 6:
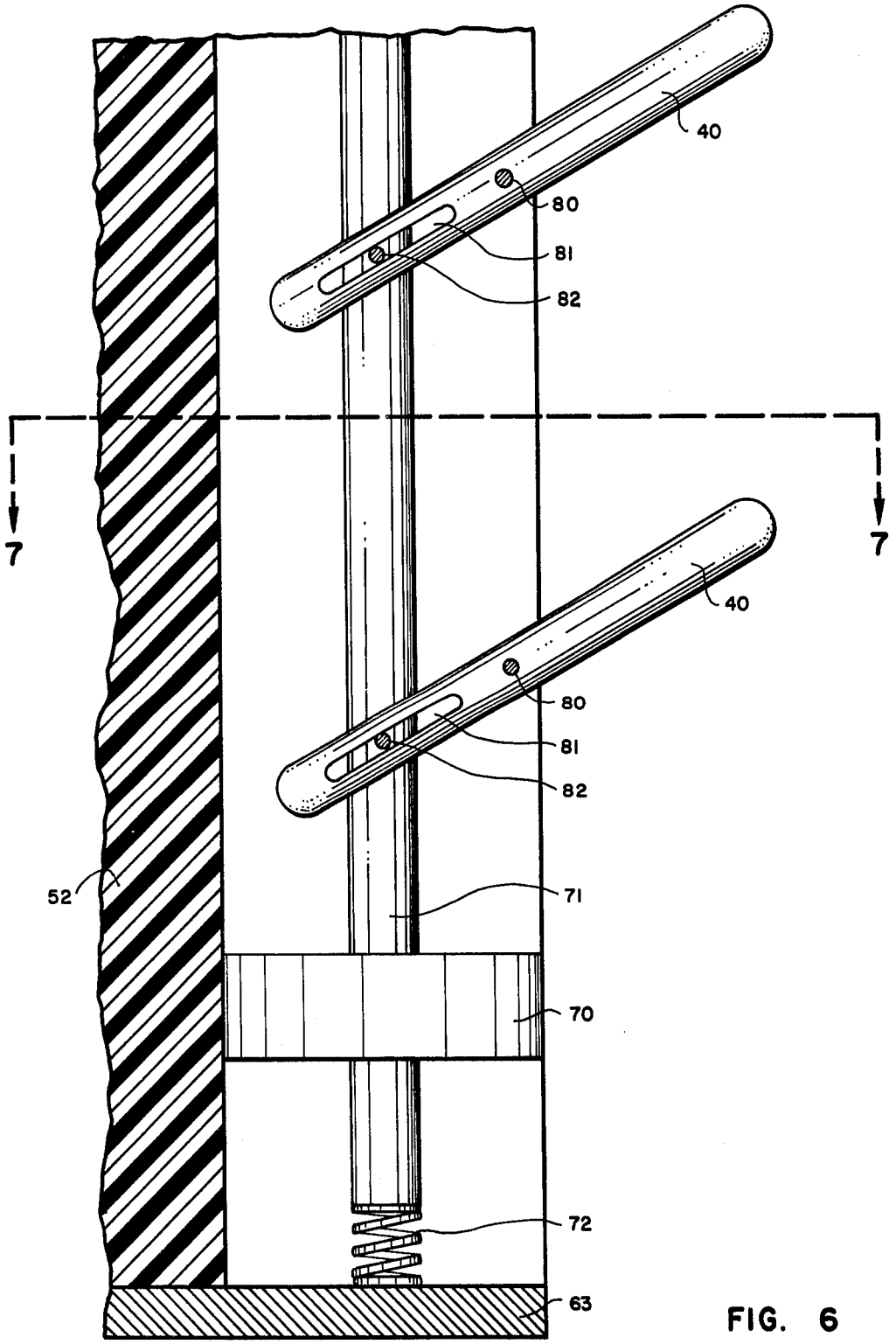
FIG. 6 is an enlarged schematic view, partly in cross section, showing the reversing mechanism for changing the direction of the slant of the vanes.

Referring now to FIG. 6, the reversing actuator is schematically illustrated and is shown as having a solenoid 70 through which a rod 71 is actuated by the solenoid. The lower end of the rod 71 is connected to a spring 72 which in turn is anchored to the end plate 63 illustrated in FIG. 5. It should be appreciated that the reversing mechanism is carried by the sleeve 53. Each of the vanes 40 is pivoted about pivot points 80 which are fixedly attached to the sliding sleeve 53. Each of the flexible vanes has an elongated slot 81 through which pivot pins 82 ride and which are fixedly attached to the solenoid rod 71.

In the operation of the apparatus in accordance with FIG. 6, whenever it is desired to have the instrument 30' travel downhole, the solenoid 70 is not actuated, and the spring 72 pulls the rod 71 down and thus causes the vanes 40 to be in the position illustrated.

Whenever it is desired to bring the instrument 30' out of the borehole, the solenoid 70 is actuated, preferably from the earth's surface, and the rod 71 moves up against the spring 72. This causes the vanes 40 to rotate around the pivot point 80 and while the pivot points 82 are sliding through the slots 81, the outer ends of the vanes will pivot down in the direction to facilitate removal of the apparatus 30' from the borehole.

Figure 7:
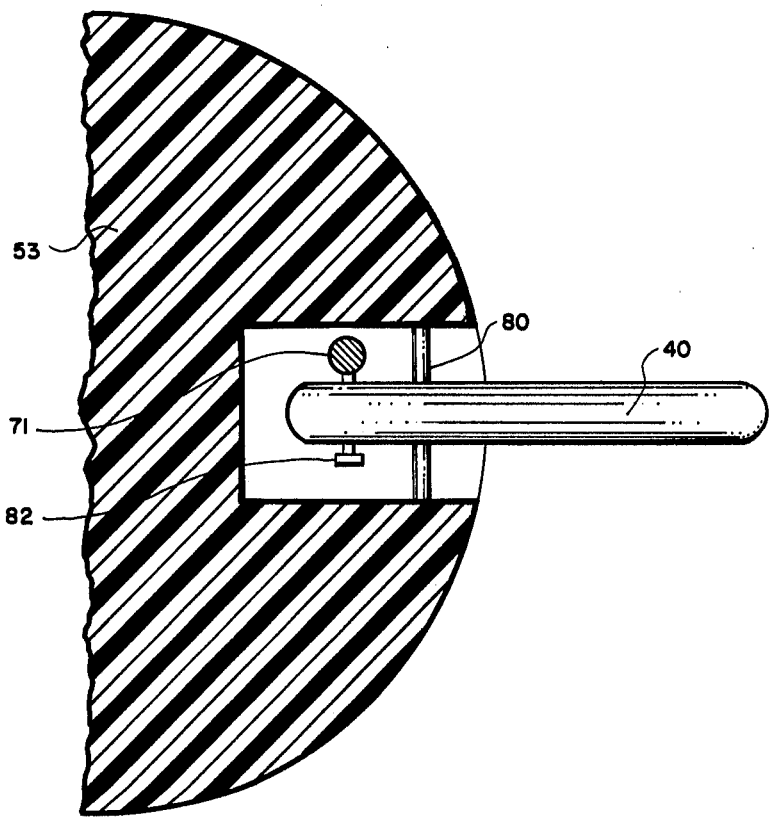
FIG. 7 is a top plan view, partly in cross section, taken along the lines 7—7 of FIG. 6.

Referring now to FIG. 7, there is illustrated a top plan view taken along the cross section lines 7—7 of FIG. 6. As shown in FIG. 7, the vane 40 is adapted to be rotated around the pivot pin 80 and is attached to the solenoid rod 71 by the pin 82 which slides within the slot 81 illustrated in FIG. 6.

Figure 8:
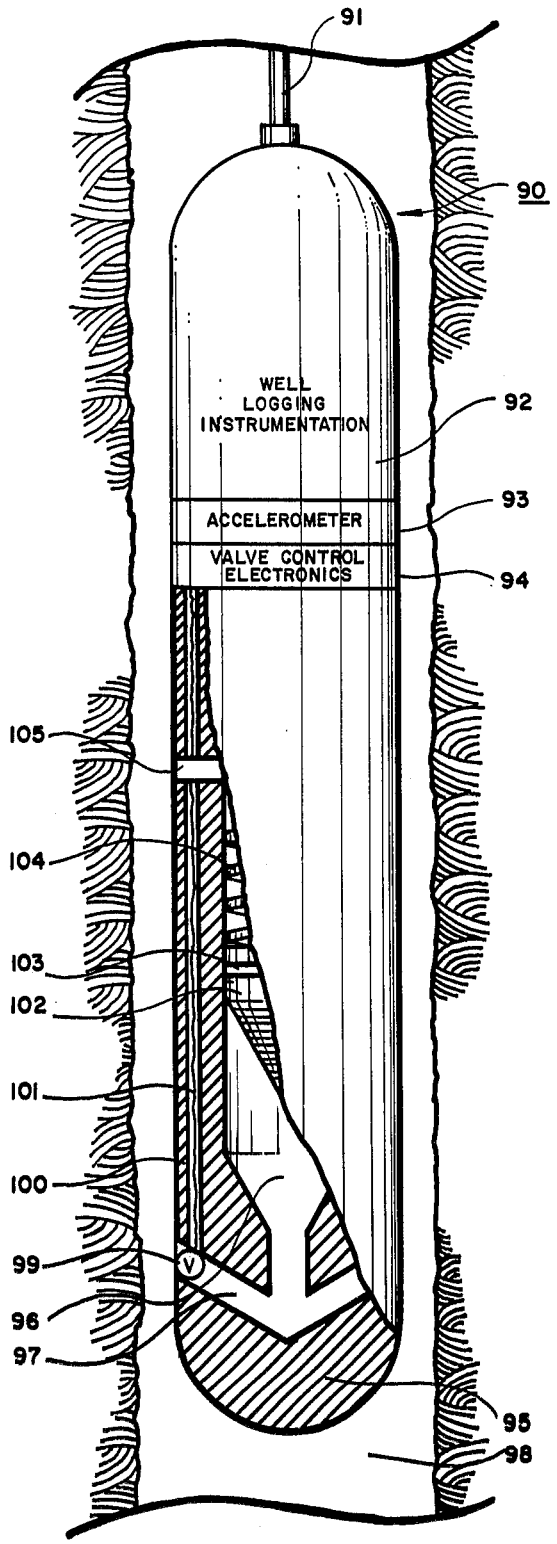
FIG. 8 is an elevated view, partly in cross section, of an apparatus according to an alternative embodiment of the present invention.

Referring now to FIG. 8, there is illustrated a well logging instrument 90 which is suspended within the earth borehole 98 by means of a well logging cable 91. The well logging instrument 90 includes an upper well logging instrumentation section 92 which may be of any conventional type. The instrument also contains an accelerometer 93 and a valve control electronics section 94. The valve control electronics section is connected by means of one or more wires 101 through a conduit 100 to a valve 99 which is located within the orifice 97 within the body 95 of the lower section of the well logging apparatus 90. The apparatus 90 also includes a fluid chamber 96 within which a friction-reduction agent is located. The chamber 96 contains a piston 102 having an O-ring or other sealing member 103. The piston 102 is forced against the fluid within the chamber 96 by means of a spring 104. A pressure equalizing port 105 maintains the upper portion of the chamber 96 in contact with the pressurized fluid within the borehole 98.

In the operation of the apparatus illustrated in FIG. 8, as the well logging instrument 90 traverses the earth borehole 98, upon a command from the valve control electronics section 94, the valve 99 is actuated and the friction-reduction agent within the chamber 96 beneath the piston 102 is ported into the borehole to reduce the friction around the well logging instrument 90. The action of the valve control electronics 94 will be more readily appreciated from the descriptions hereinafter relating to FIGS. 9 and 10. It should be understood, however, that the embodiment of FIG. 8 contemplates that the friction-reduction agent is ported into the borehole through the valve 99 only upon a command from the valve control electronics section 94.

Figure 9:
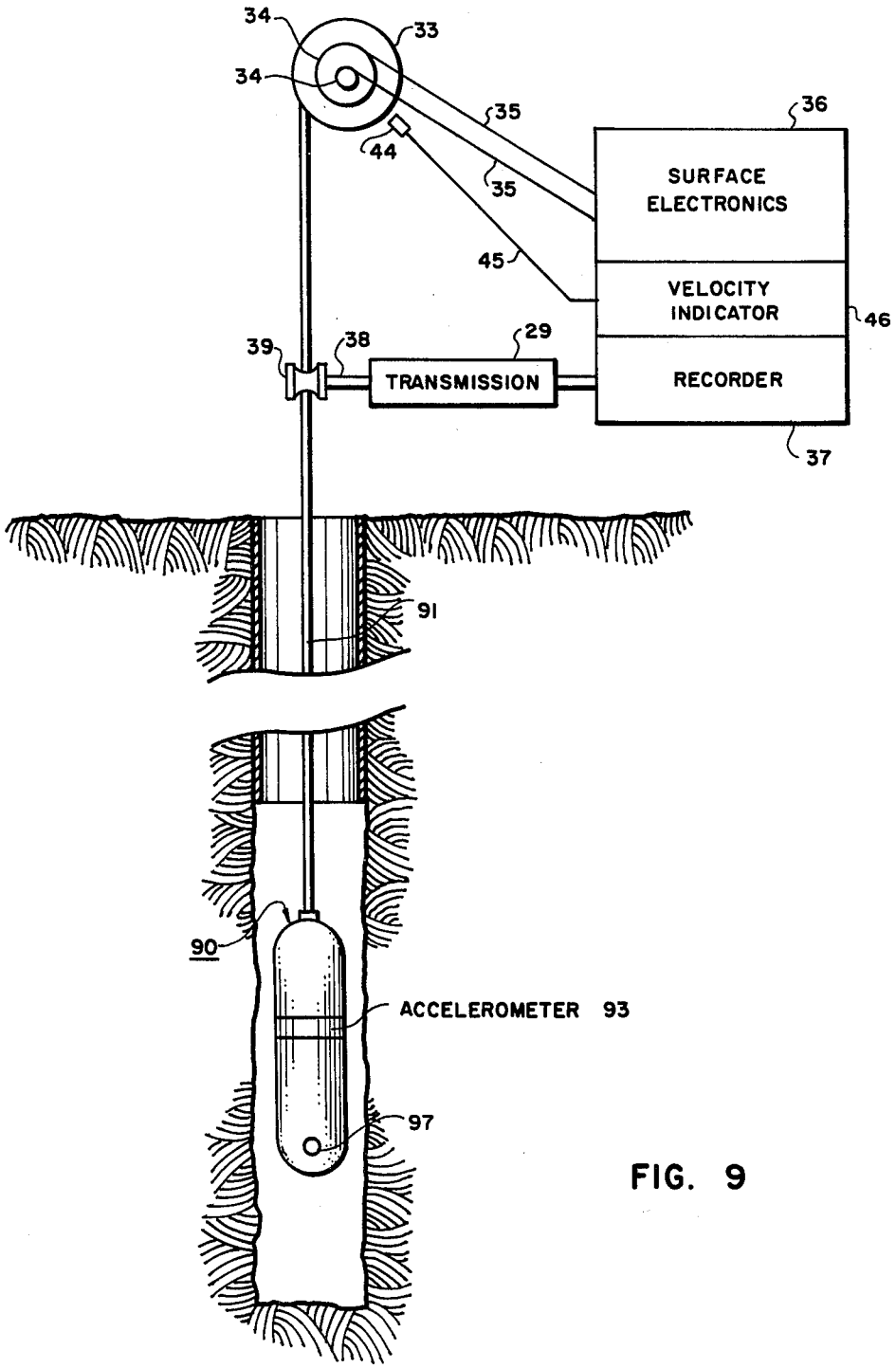
FIG. 9 is an elevated view, partly in block diagram, of the logging system used in accordance with the apparatus according to FIG. 8.

Referring now to FIG. 9, the well logging instrument 90 illustrated in FIG. 8 is shown in elevated view within an earth borehole and is suspended by a well logging cable 91 from the earth's surface and which passes over a measuring sheave 39 to the drum 33 as is illustrated in FIG. 2. However, in addition to the surface apparatus illustrated in FIG. 2, the surface apparatus of FIG. 9 includes a sensor 44 which monitors the velocity of the drum 33 as it rotates as an indication of the velocity of the logging cable 91. The signal from the sensor 44 passes over a conductor 45 to a conventional velocity indicator circuit 46. As was illustrated in FIG. 8, the well logging instrument 90 includes an accelerometer 93 which, together with the signal from the velocity indicator circuit 46 at the surface, controls the fluid which is caused to be ported from the orifice 97 in the lower portion of the well logging instrument 90.

Figure 10:
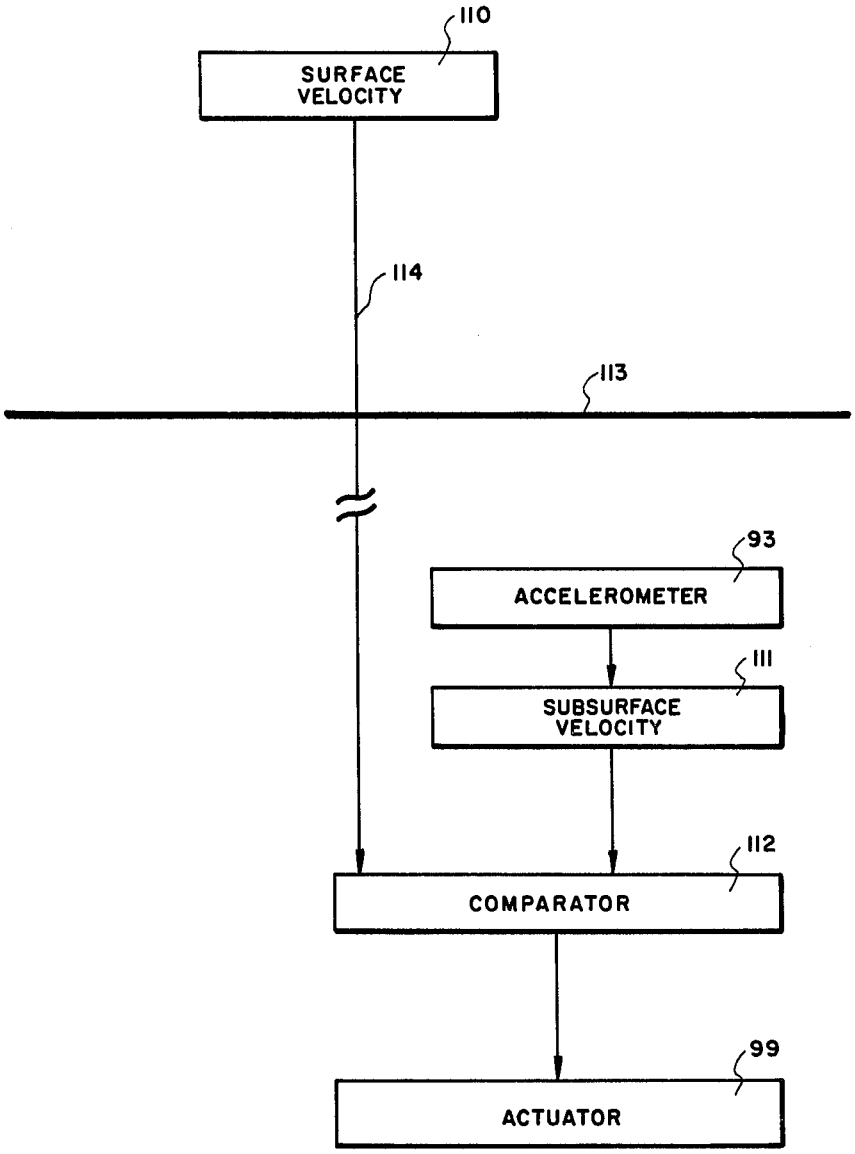
FIG. 10 illustrates in block diagram portions of the functions accomplished by the system illustrated in FIG. 9.

Referring now to FIG. 10, the functions of the apparatus illustrated and described with respect to FIGs. 8 and 9 are shown in block diagram. The block 110 is indicative of a signal relating to the surface velocity of the well logging cable, and this signal is passed along a conductor within the well logging cable, shown generally by the numeral 114, to a comparator circuit 112 which is located within the valve control electronics section 94 in the subsurface instrument 90. The line 113 is functionally related to the separation between the surface electronics and the subsurface electronics. The output from the accelerometer 93 is passed into a conventional velocity circuit 111 which converts the accelerometer signal into a velocity signal in a manner well known in the art. The velocity signal from the subsurface velocity circuit 111 is compared with the surface velocity signal 110 in the comparator circuit 112 and whenever a signal of predetermined magnitude from the comparator circuit 112 exists, a signal is passed to the actuator circuit 99, for example, the valve 99, within the orifice 97 to thereby port the fluid within the chamber 96 into the borehole.

It should be appreciated that when the well logging instrument 90 is being caused to traverse the borehole by means of the cable 91, the well logging cable at the surface will not always be traveling at the exact velocity as that of the borehole instrument. This is caused by various reasons, such as the stretch of the well logging cable and the encounter of the well logging instrument with ledges and other deviated portions within the earth borehole. However, it may not be desirable to actuate the valve 99 upon every minute difference indicated by the comparator 112. Thus, the comparator 112 can be set by means well known in the art to generate a signal to the valve or other actuator means 99 upon the difference between the two velocity signals exceeding some predetermined magnitude, for example, a 5% or 10% difference.

Thus there have been illustrated and described herein the preferred embodiments of the present invention which provide methods and apparatus for activating means to facilitate the movement of the well logging apparatus through the borehole. However, those skilled in the art will recognize that obvious modifications can be made to the preferred embodiments without departing from the spirit of the invention. For example, instead of using a high molecular weight polymer for the friction-reduction agent, other such well-known friction-reduction agents can be utilized. Furthermore, instead of using a valve dependent upon changes in velocity, other parameters can be measured and the valve or other such device for porting the friction-reduction agent into the borehole can be activated as a response to such parameters. Still further, instead of measuring the velocity of the drum at the earth's surface, the velocity of the cable can be measured in other conventional manners.

The embodiments of the invention in which an exclusive property or privilege is claimed are defined as follows:

1. Apparatus for logging the formations surrounding an earth borehole, comprising:

an elongated well logging instrument connected to the earth's surface by a well logging cable and adapted to traverse an earth borehole, said instrument having therein an accelerometer and means to convert the acceleration of said instrument into an indication of instrument velocity, said instrument also having means therein activatable to facilitate the movement of said instrument through deviated portions of said borehole;

means at the earth's surface for providing an indication of the velocity of said well logging cable at the earth's surface; and means for comparing the velocity of said instrument with the velocity of said well logging cable at the earth's surface and to generate a signal indicative of said comparison, said activatable means within said instrument being responsive to said comparison signal.

2. The apparatus according to claim 1, wherein said activatable means comprises means to propel said instrument along said borehole.

3. The apparatus according to claim 1, wherein said activatable means comprises a longitudinal support mandrel on said instrument, a sliding sleeve encircling said support mandrel, at least one vane attached to said sleeve and having a given angle with respect to said sleeve, and means to reciprocate said sleeve with respect to said mandrel and thereby impart motion to the instrument in a direction away from the angled slant of said at least one vane.

4. The apparatus according to claim 1, wherein said activatable means comprises means to port a friction-reduction agent from said instrument into said borehole.

5. A method for logging the formations surrounding an earth borehole, comprising:

causing a well logging instrument to traverse an earth borehole by means of a well logging cable from the earth's surface;

measuring the velocity of said cable at the earth's surface;

measuring the velocity of said well logging instrument;

comparing the said cable velocity with the said instrument velocity and generating a signal indicative of the comparison; and activating means within said instrument responsive to said signal which facilitates the movement of said instrument through said borehole.

6. The method according to claim 5 wherein said activatable means comprises means to port a friction-reduction agent into said borehole.

7. The method according to claim 5 wherein said activatable means comprises means to propel said instrument along said borehole.

* * * * *